US011105086B1

(12) United States Patent
Liu et al.

(10) Patent No.: US 11,105,086 B1
(45) Date of Patent: Aug. 31, 2021

(54) EASILY MOUNTED AND DISMOUNTED WOODEN HOUSE

(71) Applicant: Nanjing Tech University, Jiangsu (CN)

(72) Inventors: Feng Liu, Jiangsu (CN); Huayu Guo, Jiangsu (CN); Chao Xu, Jiangsu (CN); Yue Tang, Jiangsu (CN)

(73) Assignee: Nanjing Tech University, Nanjing (CN)

( * ) Notice: Subject to any disclaimer, the term of this patent is extended or adjusted under 35 U.S.C. 154(b) by 0 days.

(21) Appl. No.: 17/191,666

(22) Filed: Mar. 3, 2021

(30) Foreign Application Priority Data

Jul. 9, 2020 (CN) ..... 202010654840.5

(51) Int. Cl.
*E04B 1/343* (2006.01)
*E04B 1/26* (2006.01)
*E04B 2/70* (2006.01)

(52) U.S. Cl.
CPC ..... *E04B 1/343* (2013.01); *E04B 1/2604* (2013.01); *E04B 2/707* (2013.01); *E04B 2001/262* (2013.01)

(58) Field of Classification Search
CPC .. E04B 1/2604; E04B 2001/262; E04B 2/706; E04B 2/707; E04B 2/708; E04B 2/709; E04B 1/343; E04B 1/34321; E04B 1/34326; E04B 1/34384; E04B 1/10; E04B 1/26; E04B 1/66; E04B 1/80; F24F 2007/004; F24F 2007/0025
See application file for complete search history.

(56) References Cited

U.S. PATENT DOCUMENTS 1,600,647 A * 9/1926 Nels ..... E04B 1/34315 52/92.2
5,848,852 A * 12/1998 Shpigel ..... A47B 13/04 403/219
2021/0140175 A1* 5/2021 Douglas ..... E04C 2/32

FOREIGN PATENT DOCUMENTS

CN 206128310 U * 4/2017
CN 207363026 U * 5/2018
CN 210658864 U * 6/2020
CN 210767238 U * 6/2020
DE 29620737 U1 * 4/1997 ..... B27M 3/0066

* cited by examiner

*Primary Examiner* — Michael Safavi

(57) ABSTRACT

A wooden house includes a roof, a wooden frame mechanism, a base, and a fixed wall panel, wherein the wooden frame mechanism with the roof mounted on the top is inserted on the base; the present invention realizes the quick mounting and dismounting of the first main cross beam and the upright post through the matching of the vertically movable wedge block and the first wedge that fixes the wedge tenon to the wedge mortise. At the same time, because the wedge mortise is connected to the common mortise, after dismounting the first main cross beam, the second wedge and third wedge are pushed into the wedge mortise through tools, to achieve the removal of the sub-cross beam from the upright post, thereby improving the efficiency of mounting and dismounting of the entire house.

6 Claims, 9 Drawing Sheets

EASILY MOUNTED AND DISMOUNTED WOODEN HOUSE

CROSS REFERENCE TO RELATED APPLICATIONS

The present application claims the benefit of Chinese Patent Application No. 202010654840.5 filed on Jul. 9, 2020, the contents of which are incorporated herein by reference in their entirety.

FIELD OF THE INVENTION

The present invention relates to a wooden house, and in particular, to an easily mounted and dismounted wooden house.

BACKGROUND

A wooden house that is temporarily constructed is often used as a temporary studio in the shooting scenes. On the one hand, the temporarily constructed studio can be specially designed according to their own needs, and on the other hand, the cost of building a special studio can be reduced, so that more funds can be used for the shooting, thereby improving the quality of filming. However, the traditional temporary wooden houses have no ability of air conditioning due to their simple structure. Especially in winter and summer, the internal temperature of these temporary buildings cannot be guaranteed, therefore, air-conditioning equipment is often necessary, which increases the cost of the temporary wooden houses and is not energy-saving and environmentally-friendly.

In addition, the dismantling of these temporarily constructed wooden houses is troublesome, which cannot be dismantled quickly, thereby lowering the dismantling efficiency, and even possibly causing damage to some parts of the wooden house because of violent dismantling.

Therefore, it is very necessary to design a wooden house that is energy-saving and environmentally friendly, easily dismantled, and can achieve autonomous adjustment of its internal temperature without additional air-conditioning equipment.

The present invention provides an easily mounted and dismounted wooden house to solve the above problems.

SUMMARY

In order to solve the foregoing shortcoming in the prior art, the present invention discloses an easily mounted and dismounted wooden house, which is achieved through the following technical solutions.

In the description of the present invention, it should be noted that the terms that indicate the orientation or positional relationship such as "in/inside", "out/outside", "upper/up" and "lower/below", etc. based on the orientation or positional relationship shown in the drawings, or the orientation or positional relationship when the product of the invention is usually placed during use are only used for describing the invention and simplifying the description conveniently, rather than indicating or implying that the device or component referred to must have a specific orientation, be constructed or operated in a specific orientation, therefore, it cannot be constructed as a limitation to the present invention. In addition, the terms "first", "second", etc. are only used for distinguishing, rather than indicating or implying a relative importance.

An easily mounted and dismounted wooden house, comprising a roof, a wooden frame mechanism, a base, and a fixed wall panel, wherein the wooden frame mechanism with the roof mounted on the top is inserted on the base; wooden fixed wall panels with built-in thermal insulation layer are mounted around the wooden frame mechanism, and the fixed wall panels on both sides without doors and windows are provided with the same ventilation structure;

The wooden frame mechanism comprises upright posts, a first main cross beam, a sub-cross beam, a first wedge, a wedge block, a first roller, a first backing plate, a second wedge, a third wedge, a top plate, a second roller, and a second main cross beam, wherein four upright posts are mortised by two symmetrically distributed first main cross beams and two symmetrically distributed sub-cross beams, the two first main cross beams are connected by two symmetrically distributed second main cross beams, to enhance the overall stability of the wooden frame mechanism. The roof is mounted on the top of the four upright posts; a wedge tenon at one end of the first main cross beam matches a wedge mortise on the side wall of the upright post to prevent horizontal relative movement between the first main cross beam and the upright post that are mortised; an common mortise on the side wall of the upright post that is vertically connected to the wedge mortise is matched with an common tenon at one end of the sub-cross beam; the wedge block sliding vertically in the upright post is matched with the first wedge that fastens the corresponding wedge tenon to the corresponding wedge mortise; there are two rows of vertically distributed first rollers that roll horizontally in the groove on the side wall of the upright post, and a first backing plate that changes the distance between the two rows of first rollers is matched between the two rows of rollers, and the lower row of first rollers press against the wedge block.

The second wedge and the third wedge are fitted in the common mortise to fasten the common tenon inside; the wedge mortise is inserted with a top plate that is press-fitted with the corresponding second wedge, and a plurality of vertical second rollers are fitted between the top plate and the wedge tenon.

As a further improvement, the fixed wall panel with ventilation structure is provided with a trapezoidal groove, and the trapezoidal groove is fitted with two right-angled trapezium movable wall panels for opening and closing, and the two movable wall panels are matched by teeth; a sealing gasket is mounted on the teeth surface of each movable wall panel; two fixing strips are mounted symmetrically on both sides of mouth of the trapezoidal groove, and a sealing strip that matches the corresponding movable wall panel is mounted on each fixing strip, to ensure that the two movable wall panels that are fit with each other form a sealed fit when they are closed, so that the ventilation structures on the gables on both sides form an effective isolation from the inside and the outside of the present invention in the closed state and prevent wind and sand from entering the house.

Two threaded holes are symmetrically provided at the upper and lower ends of the two matched movable wall panels, and each threaded hole is screwed with a screw that drives the corresponding movable wall panel to move horizontally towards the outside of the house along the corresponding trapezoidal groove slope, and one end of each screw is mounted with a fourth bevel gear; two fourth bevel gears at the upper end of the two matched movable wall panels are engaged with each other, the two fourth bevel gears at the lower end of the two matched movable wall panels are engaged with each other; the third fixing base mounted on the first main cross beam is rotatably matched with second shaft, and the third bevel gear mounted on the second shaft is engaged with the fourth bevel gear on the upper end of the movable wall panel on the same side; a third fixing base is mounted on the fifth fixing base that is mounted on the upright post, and the third fixing base is also rotatably matched with the second shaft, the third bevel gear mounted on the second shaft is engaged with the fourth bevel gear at the lower end of the movable wall panel on the same side; the first fixing base and second fixing base are mounted on the fifth fixing base and the first main cross beam on the same side respectively; the first fixing base and second fixing base are rotatably matched with the vertical first shaft, and the first shaft is driven to rotate by an electric drive module mounted on the first main cross beam; the first shaft is transmissibly connected with the two second shafts on the same side; the screw is rotatably fit with the fourth fixing base mounted on the corresponding first main cross beam or third fixing base.

As a further improvement, the teeth surface of one of the two movable wall panels that are matched with each other is provided with a groove and the teeth surface of the other movable wall panel is mounted with a baffle that is insertably matched with the groove, and there is a gap between the baffle and the inner wall of the groove, to ensure that the baffle does not block the staggered gap between the two movable wall panels in the ventilated state while blocking the external mosquitoes that enter the house through the gap formed between the two movable wall panels. Two first bevel gears are mounted symmetrically at both ends of first shaft, and the two first bevel gears are engaged with the second bevel gears mounted on the same side of second shaft respectively; a second spur gear is mounted on the second shaft, and the second spur gear is engaged with the first spur gear mounted on the output shaft of the electric drive module.

As a further improvement, the wedge block slides vertically in a sliding chute connecting the groove and the wedge mortise; a pressing plate is mounted on the upper end of the wedge block, and the pressing plate slides vertically in the groove; the pressing plate is pressed against by the lower row of first rollers; two side walls of the upright post are provided with third slot communicating with the groove and first slot matching the first backing plate; the top plate and a plurality of second rollers are matched with second slot on the side wall of the groove; a cover plate that covers the first backing plate, the two rows of first rollers, the top plate and the plurality of second rollers is mounted through bolts at the mouths of the first slot, the wedge mortise and the second slot. The cover plate protects all components located in the groove. While the pressing plate bears the press against of all first rollers in the lower row, it limits the vertical downward sliding range of the wedge block in the sliding chute.

As a further improvement, a second backing plate slides vertically in the groove, and the second backing plate is located above the upper row of first rollers, the second backing plate and first backing plate simultaneously press against the wedge block effectively through two rows of first rollers. When the first backing plate is removed, the pressing of the wedge block against the first wedge disappears, facilitating the quick removal of first wedge. The upper and lower surfaces of the first backing plate are provided with protrusions that match the corresponding row of first rollers, the first backing plate is provided with a first draw hole that matches with the draw hook at the end close to the mouth of first slot, the protrusion on the first backing plate ensures that first backing plate moves a small distance to ensure that the press of the first wedge against the wedge block disappears, to enhance the removal efficiency of the first wedge. The top plate is provided with a second draw hole that matches with the draw hook at the end close to the mouth of second slot. When the first main cross beam needs to be detached from the upright post, the top plate is pulled out of the second slot first, and the top plate and the wedge tenon form rolling friction through the second roller, to facilitate the removal of the top plate from the second slot. When the top plate is pulled out of the second slot, the press of the second wedge and third wedge against the wedge tenon through the top plate and the second roller disappears, to facilitate the rapid removal of first main cross beam.

As a further improvement, the common mortise is provided with two first through pin holes connected to the corresponding wedge mortise symmetrically on both sides, and the wedge tenon is provided with two second pin holes one-to-one corresponding to the first pin holes; the inner wall of each second pin hole is provided with a stepped slot that is perpendicularly connected to the upper end surface of the corresponding wedge tenon; the corresponding first pin hole and second pin hole are matched with round wooden pins that prevent the wedge tenon from detaching the wedge mortise; the stepped slot is matched with the stepped wooden pin; the lower end of the stepped wooden pin is matched with the corresponding round wooden pin, and the upper end of the stepped wooden pin is matched with the first wedge. The round wooden pins that are inserted into the first pin hole and second pin hole further fix the relative position of the wedge tenon in the corresponding wedge mortise, and further prevent the relative movement of the upright post and first main cross beam in the horizontal direction, and then further fasten the upright post and the first main cross beam. The stepped wooden pin forms a press against the corresponding round wooden pin under the press against of the corresponding first wedge, to ensure that the round wooden pin will not detach from the first pin hole and second pin hole under vibration due to shaking, such that the round wooden pin can effectively fasten the upright post and the wedge tenon on the corresponding first main cross beam.

Compared with the traditional temporary wooden house, the present invention realizes the quick mounting and dismounting of the first main cross beam and the upright post through the matching of the vertically movable wedge block and the first wedge that fixes the wedge tenon to the wedge mortise. At the same time, because the wedge mortise is connected to the common mortise, after dismounting the first main cross beam, the second wedge and third wedge are pushed into the wedge mortise through tools, to achieve the removal of the sub-cross beam from the upright post, thereby improving the efficiency of mounting and dismounting of the entire house. In the present invention, the fixed wall panel of the gable is provided with a ventilation mechanism, and there is no need to mount additional air-conditioning equipment, thereby reducing the cost of air temperature adjustment in the house, and at the same time achieving the effects of energy saving and emission reduction. The present invention has a simple structure and can achieve good effect.

Figure 1:
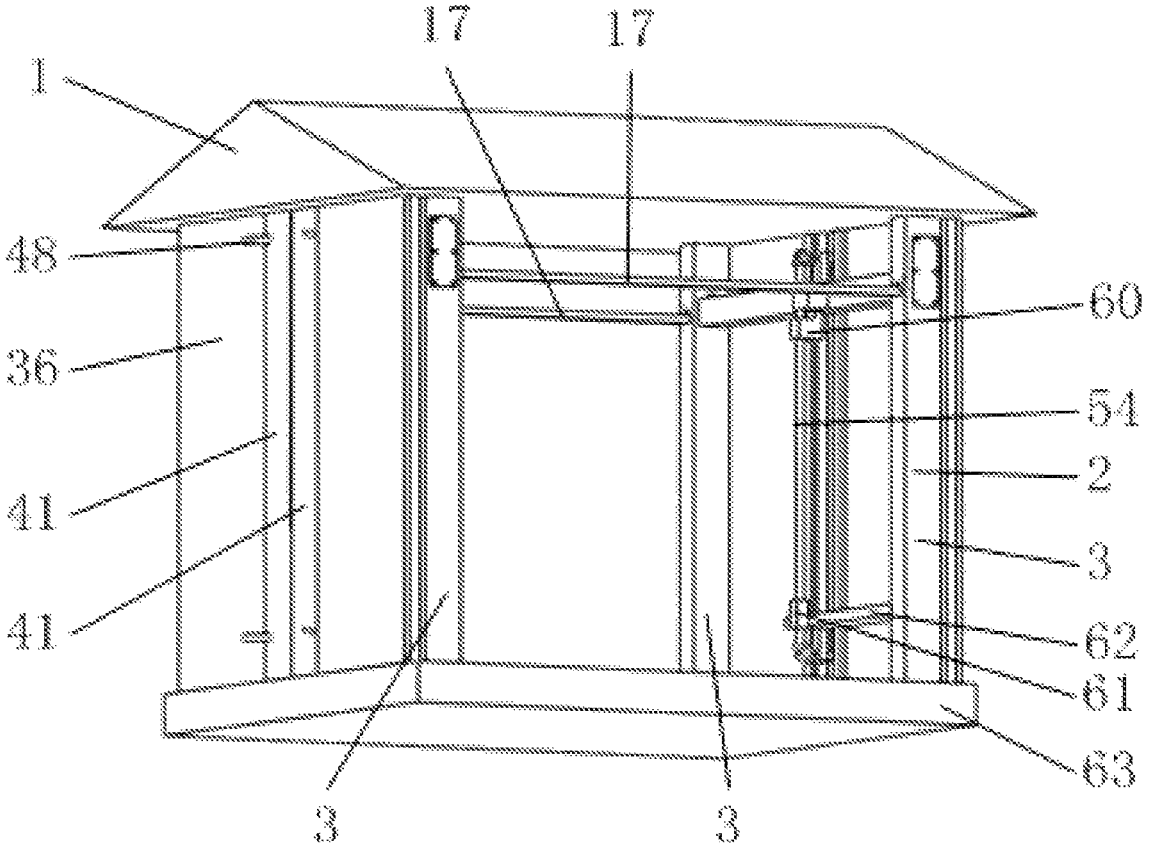
FIG. 1 is an overall schematic diagram of the present invention.

Reference numerals: 1. roof; 2. wooden frame mechanism; 3. upright post; 4. wedge mortise; 5. second slot; 6. first slot; 7. groove; 8. third slot; 9. sliding chute; 10. first pin hole; 11. common mortise; 12. cover plate; 13. first main cross beam; 14. wedge tenon; 15. second pin hole; 16. stepped slot; 17. sub-cross beam; 18. common tenon; 19. bolt; 20. stepped wooden pin; 21. round wooden pin; 22. first wedge; 23. wedge block; 24. pressing plate; 25. first roller; 26. first backing plate; 27. protrusion; 28. first draw hole; 30. second backing plate; 31. second wedge; 32. third wedge; 33. top plate; 34. second draw hole; 35. second roller; 36. fixed wall panel; 37. thermal insulation layer; 39. fixing strip; 40. sealing strip; 41. movable wall panel; 43. teeth; 44. groove; 45. threaded hole; 46. baffle; 47. sealing gasket; 48. screw; 49. fourth bevel gear; 50. third bevel gear; 51. second shaft; 52. second bevel gear; 53. first bevel gear; 54. first shaft; 55. second spur gear; 56. first spur gear; 57. electric drive module; 58. fourth fixing base; 59. third fixing base; 60. second fixing base; 61. first fixing base; 62. fifth fixing base; 63. base; 64. trapezoidal groove; 65. second main cross beam.

DETAILED DESCRIPTION

The drawings are schematic diagrams of the implementation of the present invention, to understand the principle of structural operation. The specific product structure and proportional size can be determined according to the use environment and conventional art.

As shown in FIG. 1, it comprises a roof 1, a wooden frame mechanism 2, a base 63, and a fixed wall panel 36, wherein the wooden frame mechanism 2 with the roof 1 mounted on the top is inserted on the base 63; wooden fixed wall panels 36 with built-in thermal insulation layer 37 are mounted around the wooden frame mechanism 2, and the fixed wall panels 36 on both sides without doors and windows are provided with the same ventilation structure.

Figure 8:
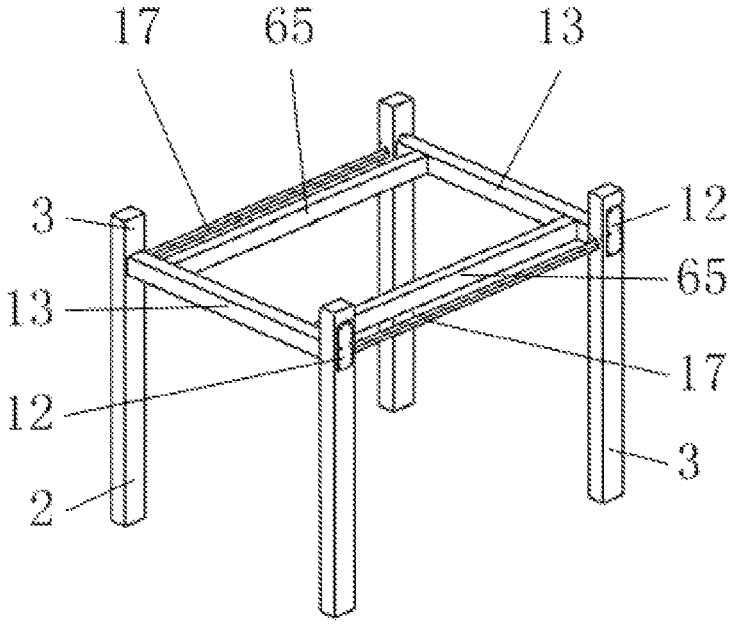
FIG. 8 is a schematic diagram of a wooden frame mechanism.
Figure 9:
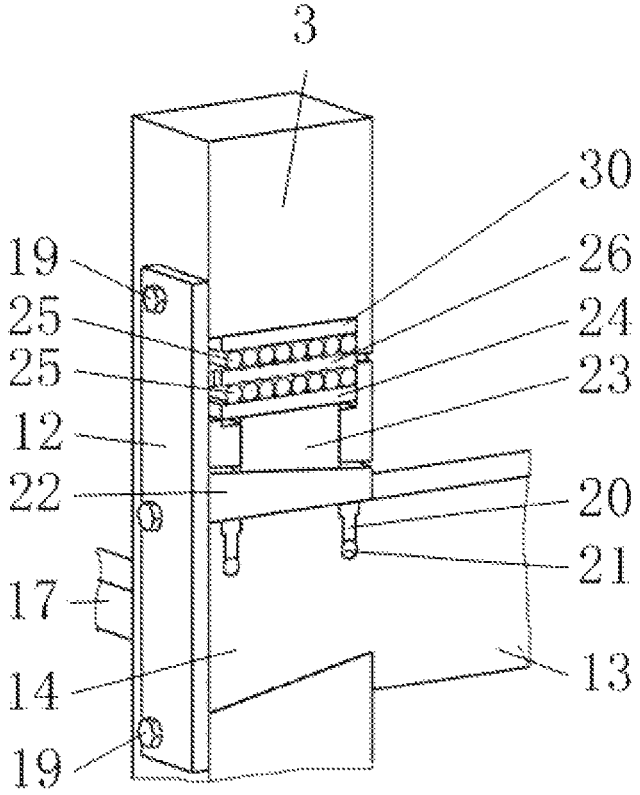
FIG. 9 is a schematic cross-sectional view of a first main cross beam that matches with the upright post.
Figure 10:
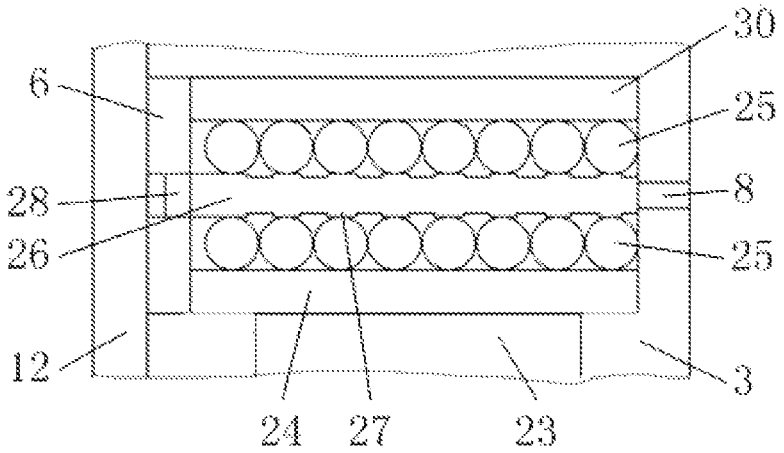
FIG. 10 is a schematic cross-sectional view of a wedge block, a pressing plate, a first roller, a first backing plate, a roller that match with the second backing plate.
Figure 15:
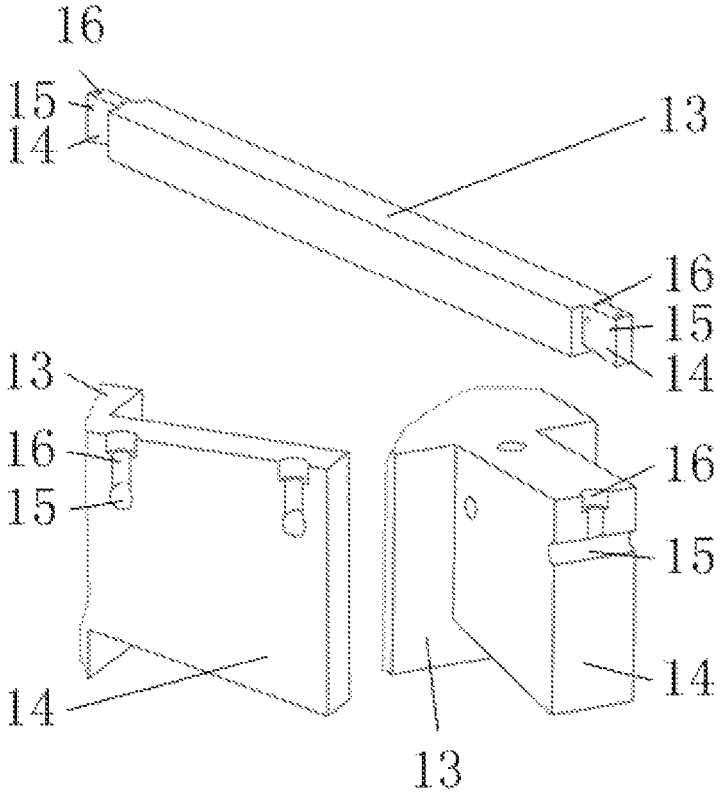
FIG. 15 is a schematic cross-sectional view of a first main cross beam and two viewing angles thereof.
Figure 16:
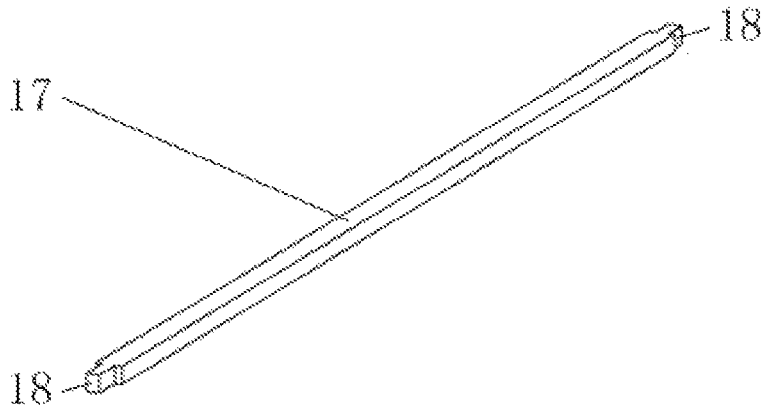
FIG. 16 is a schematic diagram of a sub-cross beam.

As shown in FIG. 8, the wooden frame mechanism 2 comprises upright posts 3, a first main cross beam 13, a sub-cross beam 17, a first wedge 22, a wedge block 23, a first roller 25, a first backing plate 26, a second wedge 31, a third wedge 32, a top plate 33, a second roller 35, and a second main cross beam 65, wherein, as shown in FIG. 8, four upright posts 3 are mortised by two symmetrically distributed first main cross beams 13 and two symmetrically distributed sub-cross beams 17, the two first main cross beams 13 are connected by two symmetrically distributed second main cross beams 65, to enhance the overall stability of the wooden frame mechanism 2. As shown in FIGS. 1 and 8, the roof 1 is mounted on the top of the four upright posts 3; as shown in FIGS. 9, 14 and 15, a wedge tenon 14 at one end of the first main cross beam 13 matches a wedge mortise 4 on the side wall of the upright post 3 to prevent horizontal relative movement between the first main cross beam 13 and the upright post 3 that are mortised; as shown in FIGS. 11, 14 and 16, an common mortise 11 on the side wall of the upright post 3 that is vertically connected to the wedge mortise 4 is matched with an common tenon 18 at one end of the sub-cross beam 17; as shown in FIG. 9, the wedge block 23 sliding vertically in the upright post 3 is matched with the first wedge 22 that fastens the corresponding wedge tenon 14 to the corresponding wedge mortise 4; as shown in FIGS. 9, 10 and 14, there are two rows of vertically distributed first rollers 25 that roll horizontally in the groove 7 on the side wall of the upright post 3, and a first backing plate 26 that changes the distance between the two rows of first rollers 25 is matched between the two rows of rollers, and the lower row of first rollers 25 press against the wedge block 23.

Figure 11:
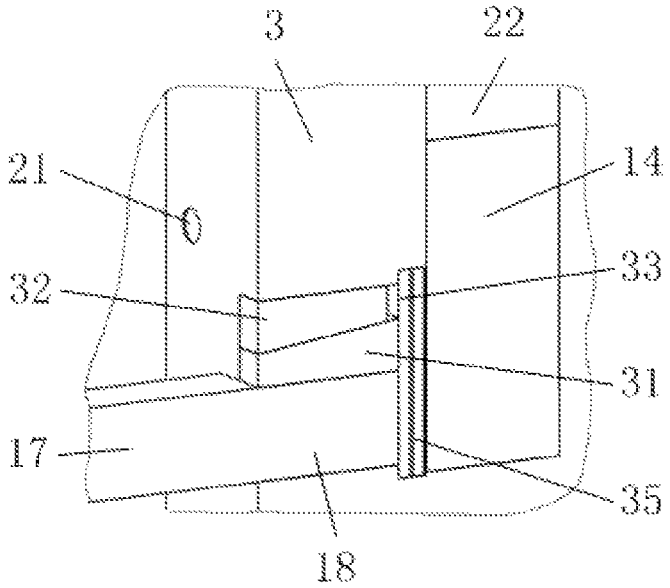
FIG. 11 is a schematic cross-sectional view of an upright post that matches with a sub-cross beam.
Figure 12:
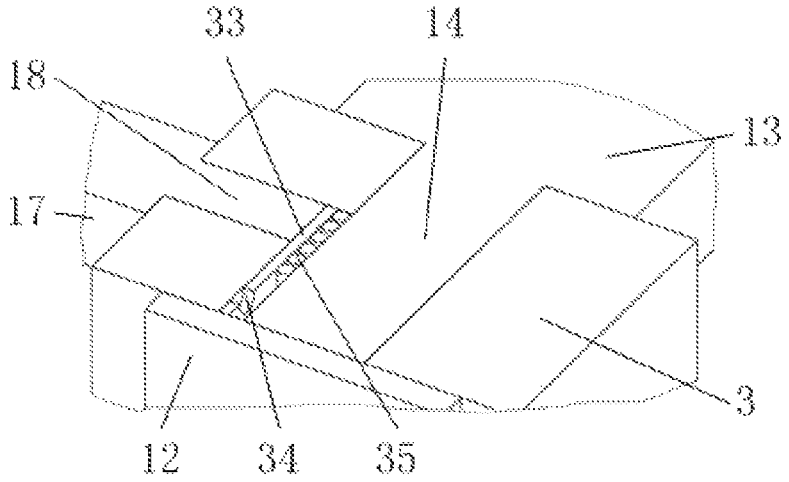
FIG. 12 is a schematic cross-sectional view of a common tenon, a top plate, a second roller on a sub-cross beam that match with a wedge tenon on a first main cross beam.
Figure 13:
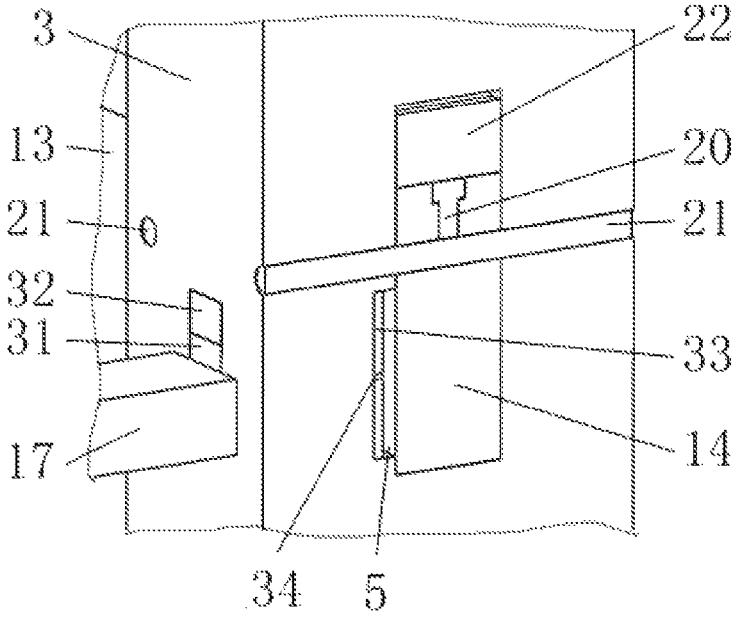
FIG. 13 is a schematic cross-sectional view of a first wedge, a stepped wooden pin, a round wooden pin that match with a wedge tenon on a main cross beam.
Figure 14:
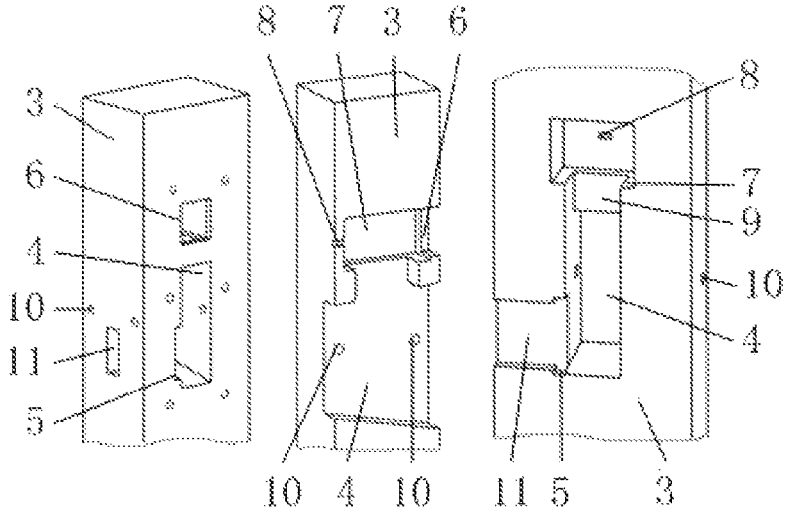
FIG. 14 is a schematic cross-sectional view of a part of an upright post and two viewing angles thereof.

As shown in FIGS. 11 and 13, the second wedge 31 and the third wedge 32 are fitted in the common mortise 11 to fasten the common tenon 18 inside; as shown in FIGS. 11, 12 and 14, the wedge mortise 4 is inserted with a top plate 33 that is press-fitted with the corresponding second wedge, and a plurality of vertical second rollers 35 are fitted between the top plate 33 and the wedge tenon 14.

Figure 2:
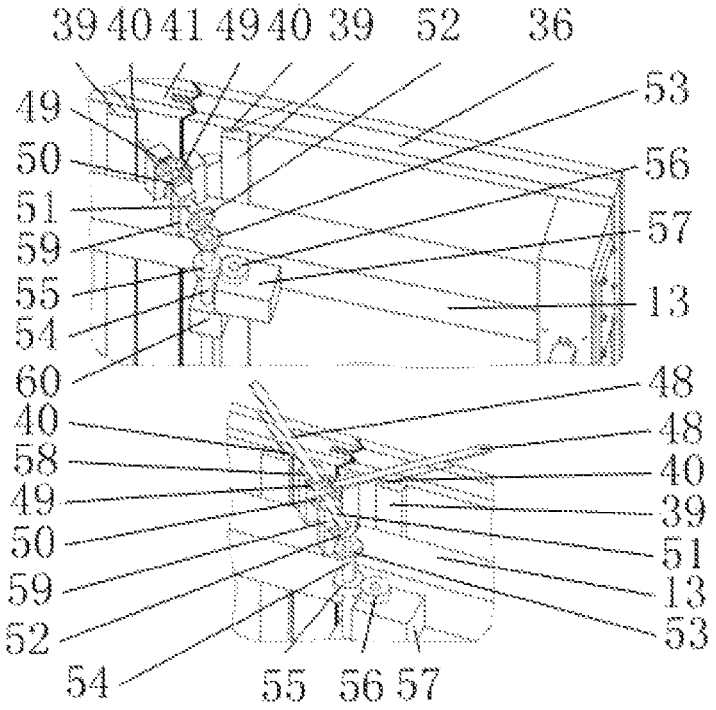
FIG. 2 is a schematic cross-sectional view of a screw, fourth bevel gear, third bevel gear, second shaft, second bevel gear, first bevel gear, first shaft, second spur gear, first spur gear, and electric drive module that match with the upper end of the movable wall panel.
Figure 3:
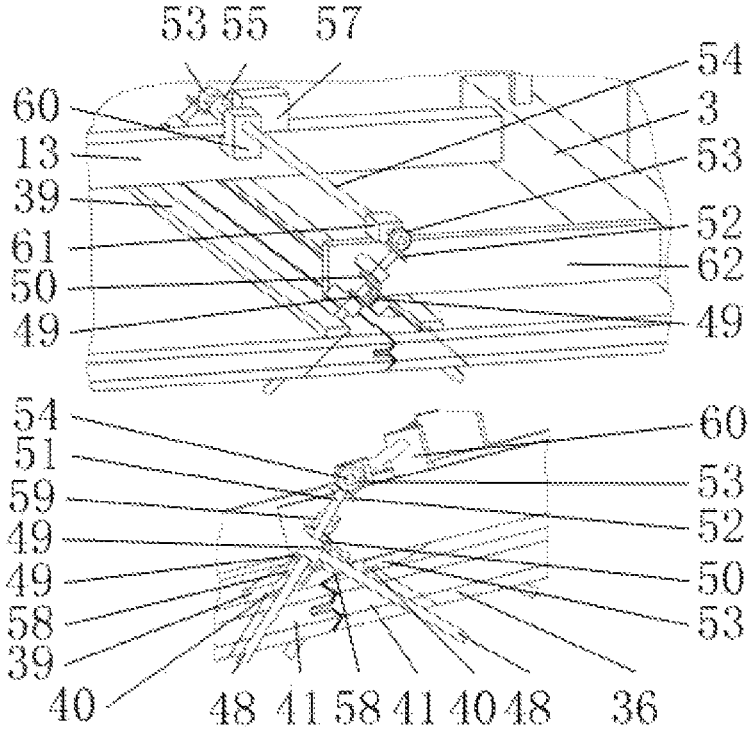
FIG. 3 is a schematic cross-sectional view of a screw, fourth bevel gear, third bevel gear, second shaft, second bevel gear, first bevel gear and first shaft that match with the upper end of the movable wall panel.
Figure 4:
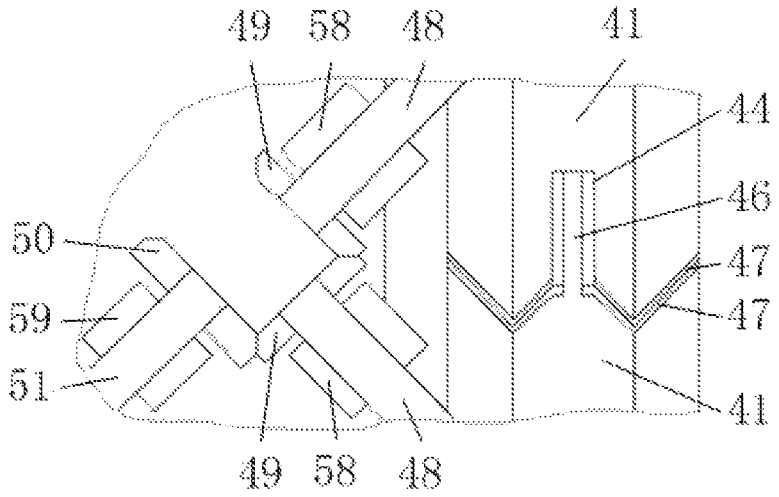
FIG. 4 is a schematic cross-sectional view of two movable wall panels that match with each other on the same fixed wall panel.
Figure 7:
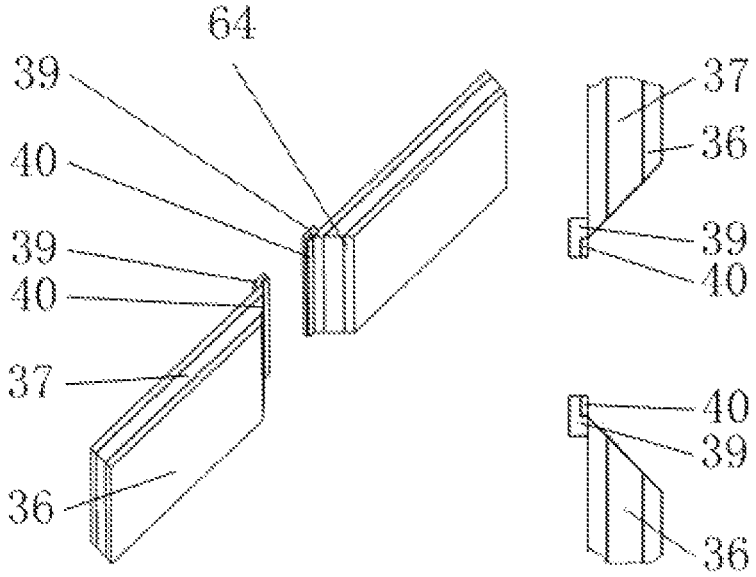
FIG. 7 is a schematic view of a single-sided fixed wall panel, a fixing strip that match with a sealing strip from two perspectives.

As shown in FIGS. 2, 3 and 7, the fixed wall panel 36 with ventilation structure is provided with a trapezoidal groove 64, and the trapezoidal groove 64 is fitted with two right-angled trapezium movable wall panels 41 for opening and closing, and the two movable wall panels 41 are matched by teeth 43; as shown in FIG. 4, a sealing gasket 47 is mounted on the teeth 43 surface of each movable wall panel 41; as shown in FIGS. 2, 3, and 7, two fixing strips 39 are mounted symmetrically on both sides of mouth of the trapezoidal groove 64, and a sealing strip 40 that matches the corresponding movable wall panel 41 is mounted on each fixing strip 39, to ensure that two movable wall panels 41 that are matched with each other form a sealed fit when they are in a closed state, so that the ventilation structures on the gables on both sides form an effective isolation from the inside and the outside of the present invention in a closed state, and prevent wind and sand from entering the house.

Figure 5:
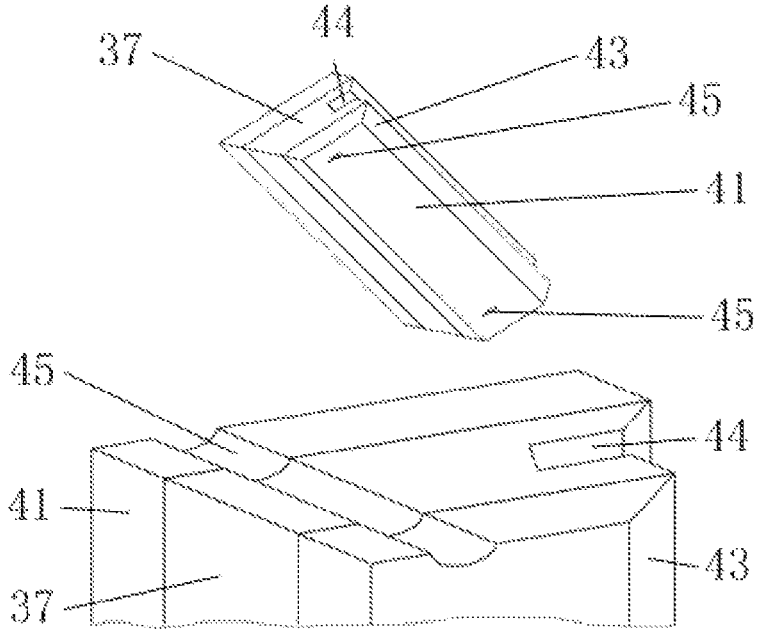
FIG. 5 is a schematic cross-sectional view of a movable wall panel with a groove.
Figure 6:
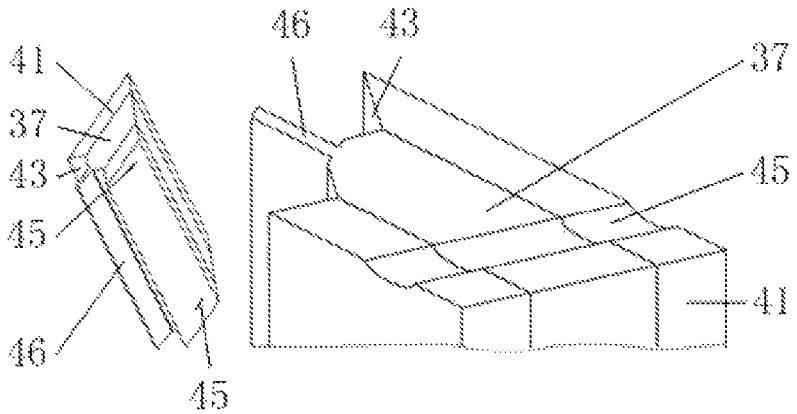
FIG. 6 is a schematic cross-sectional view of a movable wall panel with a baffle.

As shown in FIGS. 5 and 6, two threaded holes 45 are symmetrically provided at the upper and lower ends of the two matched movable wall panels 41; as shown in FIGS. 2 and 3, each threaded hole 45 is screwed with a screw 48 that drives the corresponding movable wall panel 41 to move horizontally towards the outside of the house along the corresponding trapezoidal groove 64 slope, and one end of each screw 48 is mounted with a fourth bevel gear 49; two fourth bevel gears 49 at the upper end of the two matched movable wall panels 41 are engaged with each other, the two fourth bevel gears 49 at the lower end of the two matched movable wall panels 41 are engaged with each other; as shown in FIGS. 2, 3 and 4, the third fixing base 59 mounted on the first main cross beam 13 is rotatably matched with second shaft 51, and the third bevel gear 50 mounted on the second shaft 51 is engaged with the fourth bevel gear 49 on the upper end of the movable wall panel 41 on the same side; a third fixing base 59 is mounted on the fifth fixing base 62 that is mounted on the upright post 3, and the third fixing base 59 is also rotatably matched with the second shaft 51, the third bevel gear 50 mounted on the second shaft 51 is engaged with the fourth bevel gear 49 at the lower end of the movable wall panel 41 on the same side; the first fixing base 61 and second fixing base 60 are mounted on the fifth fixing base 62 and the first main cross beam 13 on the same side respectively; the first fixing base 61 and second fixing base 60 are rotatably matched with the vertical first shaft 54, and the first shaft 54 is driven to rotate by an electric drive module 57 mounted on the first main cross beam 13; the first shaft 54 is transmissibly connected with the two second shafts 51 on the same side; the screw 48 is rotatably fit with the fourth fixing base 58 mounted on the corresponding first main cross beam 13 or third fixing base 59.

As shown in FIGS. 4, 5 and 6, the teeth 43 surface of one of the two movable wall panels 41 that are matched with each other is provided with a groove 44 and the teeth 43 surface of the other movable wall panel 41 is mounted with a baffle 46 that is insertably matched with the groove 44, and there is a gap between the baffle 46 and the inner wall of the groove 44, to ensure that the baffle 46 does not block the staggered gap between the two movable wall panels 41 in the ventilated state while blocking the external mosquitoes that enter the house through the gap formed between the two movable wall panels 41. As shown in FIGS. 2 and 3, two bevel gears A 53 are mounted symmetrically at both ends of first shaft 54, and the two first bevel gear 53 are engaged with the second bevel gears 52 mounted on the same side of second shaft 51 respectively; a second spur gear 55 is mounted on the second shaft 51, and the second spur gear 55 is engaged with the first spur gear 56 mounted on the output shaft of the electric drive module 57.

As shown in FIGS. 9 and 14, the wedge block 23 slides vertically in a sliding chute 9 connecting the groove 7 and the wedge mortise 4; as shown in FIGS. 9 and 10, a pressing plate 24 is mounted on the upper end of the wedge block 23, and the pressing plate 24 slides vertically in the groove 7; the pressing plate 24 is pressed against by the lower row of first rollers 25; as shown in FIG. 14, two side walls of the upright post 3 are provided with third slot 8 communicating with the groove 7 and first slot 6 matching the first backing plate 26; As shown in FIGS. 12, 13 and 14, the top plate 33 and a plurality of second rollers 35 are matched with second slot 5 on the side wall of the groove 7; a cover plate 12 that covers the first backing plate 26, the two rows of first rollers 25, the top plate 33 and the plurality of second rollers 35 is mounted through bolts 19 at the mouths of the first slot 6, the wedge mortise 4 and the second slot 5. The cover plate 12 protects all components located in the groove 7. While the pressing plate 24 bears the press against of all first rollers 25 in the lower row, it limits the vertical downward sliding range of the wedge block 23 in the sliding chute 9.

As shown in FIGS. 9 and 10, a second backing plate 30 slides vertically in the groove 7, and the second backing plate 30 is located above the upper row of first rollers 25, the second backing plate 30 and first backing plate 26 simultaneously press against the wedge block 23 effectively through two rows of first rollers 25. When the first backing plate 26 is removed, the pressing of the wedge block 23 against the first wedge 22 disappears, facilitating the quick removal of first wedge 22. The upper and lower surfaces of the first backing plate 26 are provided with protrusions 27 that match the corresponding row of first rollers 25, the first backing plate 26 is provided with a first draw hole that matches with the draw hook at the end close to the mouth of first slot 6, the protrusion 27 on the first backing plate 26 ensures that first backing plate 26 moves a small distance to ensure that the press of the first wedge 22 against the wedge block 23 disappears, to enhance the removal efficiency of the first wedge 22. As shown in FIG. 12, the top plate 33 is provided with a second draw hole 34 that matches with the draw hook at the end close to the mouth of second slot 5. When the first main cross beam 13 needs to be detached from the upright post 3, the top plate 33 is pulled out of the second slot 5 first, and the top plate 33 and the wedge tenon 14 form rolling friction through the second roller 35, to facilitate the removal of the top plate 33 from the second slot 5. When the top plate 33 is pulled out of the second slot 5, the press of the second wedge 31 and third wedge 32 against the wedge tenon 14 through the top plate 33 and the second roller 35 disappears, to facilitate the rapid removal of first main cross beam.

As shown in FIGS. 14 and 15, the common mortise 11 is provided with two first through pin holes 10 connected to the corresponding wedge mortise 4 symmetrically on both sides, and the wedge tenon 14 is provided with two second pin holes 15 one-to-one corresponding to the first pin holes 10; the inner wall of each second pin hole 15 is provided with a stepped slot 16 that is perpendicularly connected to the upper end surface of the corresponding wedge tenon 14; as shown in FIGS. 9 and 13, the corresponding first pin hole 10 and second pin hole 15 are matched with round wooden pins 21 that prevent the wedge tenon 14 from detaching the wedge mortise 4; the stepped slot 16 is matched with the stepped wooden pin 20; the lower end of the stepped wooden pin 20 is matched with the corresponding round wooden pin 21, and the upper end of the stepped wooden pin 20 is matched with the first wedge 22. The round wooden pins 21 that are inserted into the first pin hole 10 and second pin hole 15 further fix the relative position of the wedge tenon 14 in the corresponding wedge mortise 4, and further prevent the relative movement of the upright post 3 and first main cross beam 13 in the horizontal direction, and then further fasten the upright post 3 and the first main cross beam 13. The stepped wooden pin 20 forms a press against the corresponding round wooden pin 21 under the press against of the corresponding first wedge 22, to ensure that the round wooden pin 21 will not detach from the first pin hole 10 and second pin hole 15 under vibration due to shaking, such that the round wooden pin 21 can effectively fasten the upright post 3 and the wedge tenon 13 on the corresponding first main cross beam 13.

The connection between the first main cross beam 13 and the second main cross beam 65 in the present invention adopts the prior art.

The electric drive module 57 in the present invention adopts the prior art and is mainly composed of a motor, a reducer and a control unit.

In the present invention, the length of the first roller 25 is equal to the horizontal width of the groove 7, to prevent the roller from falling out of the groove 7.

Generally, the most stressed part in a wooden house is the connection between the main cross beam and the upright post. The connection must be very firm, so it is most difficult to be disassembled. In the present invention, it is designed to easily disassemble the first main cross beam 13 and the upright post 3, and easily disassemble the sub-cross beam 17 and the upright post. Because other connections of the house are subjected to low force, the conventional connection methods are relatively easy to disassemble and conventional art is used in other connection positions.

The work flow of the present invention is as follows: various components in the invention are in a disassembled and separated state initially. The two rows of first rollers 25 are located in the corresponding groove 7, the pressing plate 24 is located under the lower row of first roller 25, the first backing plate 26 is located between the two rows of first rollers 25, the wedge block 23 is located in the sliding chute 9 on the upright post 3, and the lower end part of the wedge block 23 is located in the wedge mortise 4, the cover plate 12 is mounted at the mouth of the groove 7 through bolt 19. Each first roller 25 is in contact with the corresponding protrusion 27 on the first backing plate 26. The first shaft 54 is rotatably matched with the first fixing base 61 and the second fixing base 60. The second shaft 51 is rotatably matched with the third fixing base 59, and the screw 48 is rotatably matched with the fourth fixing base 58.

When the present invention needs to be built, the cover plate 12 on the upright post 3 is disassembled firstly, and the stepped wooden pin 20 is inserted to the stepped slot 16 on the wedge tenon 14 at both ends of the first main cross beam 13, so that the lower end part of the stepped wooden pin 20 enters the corresponding second pin hole 15, and the upper end of the stepped wooden pin 20 is flush with the upper surface of the wedge tenon 14. Then two first main cross beams 13 and four upright posts 3 are mortised in a one-to-two manner, and each two upright posts 3 are connected by a first main cross beam 13. A wedge tenon 14 at one end of the first main cross beam 13 is horizontally inserted into the wedge mortise 4 on the upright post 3, then the first main cross beam 13 is pressed down, such that the wedge tenon 14 on the first main cross beam 13 is fully matched with the wedge mortise 4 on the upright post 3, and two second pin holes 15 on the wedge tenon 14 correspond to the two first pin holes 10 on the upright post 3 respectively. A round wooden pin 21 is inserted into the first pin hole 10 and second pin hole 15 that are opposite, to realize the relative positioning of the wedge tenon 14 and the upright post 3.

Next, a first wedge 22 is inserted into the gap between the wedge block 23 and the wedge tenon 14 located in the wedge mortise 4, such that the lower surface of the first wedge 22 is in contact with the upper end surfaces of the two stepped wooden pins 20, and then the first wedge 22 is continuously driven into the gap in the wedge mortise 4 between the wedge block 23 and the wedge tenon 14. With the first wedge 22 continues to be driven in, the first wedge 22 forms a press against the wedge block 23 and the corresponding two stepped wooden pins 20, and the two stepped wooden pins 20 form against the two round wooden pins 21 respectively, such that the two round wooden pins 21 are fixed in first pin hole 10 and second pin hole 15 and are not easy to fall off, to realize the relative fixation of first wedge 22 to upper post 3 and wedge tenon 14 on first main cross beam 13, and further realize the relatively fixed connection between the two ends of the first main cross beam 13 and the two upright posts 3.

Then, two sub-cross beams 17 are connected to four upright posts 3. The common tenon 18 on the sub-cross beam 17 is inserted into the common mortise 11 on the upright post 3, and the top plate 33 is inserted into the second slot 5 on the upright post 3 and is in contact with the end of the common tenon 18 of the sub-cross beam 17, and then a plurality of second rollers 35 are sequentially mounted into the second slot 5 and are located between the top plate 33 and the wedge tenon 14. The second wedge 31 and third wedge 32 that are matched with each other are driven into the space above the common tenon 18 in the common mortise 11, and the third wedge 32 is hammered to make the second wedge 31 to move horizontally in the direction of wedge mortise 4. When one end of the second wedge 31 abuts against the top plate 33 to stop moving, the second wedge 31 is hammered continuously, such that the second wedge 31 further produces movement relative to the third wedge 32, and the second wedge 31 and third wedge 32 form effective fixation on the sub-cross beam 17 between the common tenon 18 and the upright post 3. The top plate 33 forms a certain degree of press against the side of the wedge tenon 14 on the corresponding first main cross beam 13 through a plurality of second rollers 35, and further locks the relative position between the first main cross beam 13 and the upright post 3. The cover plate 12 is mounted on the mouths of the second slot 5, wedge mortise 4 and first slot 6 through bolt 19 to prevent the first backing plate 26, top plate 33 and second roller 35 from falling off.

In order to make the wooden frame mechanism 2 more stable, two first main cross beams 13 are connected by two second main cross beams 65, thereby completing the assembly of the wooden frame mechanism 2.

Next, the wooden frame mechanism 2 is inserted on the base 63 and the fixed wall panel 36 is enclosed on the four upright posts 3. The second shaft 51 is mounted on the two first main cross beam 13, respectively, and the fifth fixing base 62 is mounted on the upright post 3 at both sides, and two shafts A 54 are mounted on the two first main cross beams 13 at both sides respectively. Two electric drive modules 57 are mounted on two first main cross beams 13 respectively. Two screws 48 are mounted on each first main cross beam 13, and the two screws 48 are respectively screwed with the threaded holes 45 on the upper ends of the two movable wall panels 41 installed in the trapezoidal groove 64 of the fixed wall panel 36 on the same side. Two screws 48 are installed on each fifth fixing base 62, and the two screws 48 are respectively screwed with the lower end threaded holes 45 of the two movable wall panels 41 mounted in the trapezoidal groove 64 of the fixed wall panel 36 on the same side. The fourth bevel gears 49 on the two corresponding screw 48 are engaged with each other, the third bevel gear 50 mounted on the second shaft 51 is engaged with the fourth bevel gear 49 mounted on the corresponding screw 48, and the second bevel gear 52 installed on the second shaft 51 is engaged with the first bevel gear 53 mounted on one end of the corresponding first shaft 54, and the second spur gear 55 mounted on the first shaft 54 is engaged with the first spur gear 56 mounted on the output shaft of the electric drive module 57 on the same side. Finally, the roof 1 is mounted and fixed on the top of the four upright posts 3 to complete the assembly of the present invention, and the mounting of the roof 1 on the top of the four upright posts 3 adopts the prior art.

When the assembled house needs ventilation, the two electric drive modules 57 are controlled to operate simultaneously. Each electric drive module 57 drives the corresponding first shaft 54 to rotate through the corresponding first spur gear 56 and second spur gear 55, and the first shaft 54 drives the corresponding upper and lower second bevel gears 52 to rotate through two corresponding bevel gears A 53. Each second bevel gear 52 drives the corresponding two fourth bevel gears 49 to rotate through the corresponding second shaft 51 and third bevel gear 50. The upper and lower four fourth bevel gears 49 on the same side drive the corresponding screw 48 to rotate synchronously, and the four screws 48 simultaneously drive the two movable wall panels 41 that are matched with each other on the same side to move outside the house along the slope of the trapezoidal groove 64 on the corresponding fixed wall panel 36, and the two movable wall panels 41 on the same side separate a ventilation gaps while moving to the outside of the house, to achieve natural adjustment of the air or temperature in the house. The baffle 46 mounted on one movable wall panel 41 is always located in the groove 44 on the other movable wall panel 41. The matching of the baffle 46 and the groove 44 increases the travel of the mosquitoes from the gap into the house, forming a small labyrinth to a certain extent, reducing the chance of mosquitoes to enter the house through the gap smoothly and thereby achieving the effect of preventing mosquitoes.

When the ventilation is over, the two electric drive modules 57 are controlled to operate reversely. The electric drive module 57 drives the two movable wall panels 41 on the fixed wall panel 36 through a series of transmissions to seal and reset the trapezoidal groove 64 on the fixed wall panel 36, so as to achieve the effect of heat preservation in the house in cold days.

When the present invention needs to be dismantled after use, the roof 1, fixed wall panel 36, wooden frame mechanism 2 and base 63 can be dismantled in sequence. The dismantling process of the wooden frame mechanism 2 is as follows:

Firstly, remove the two second main cross beams 65 from the two first main cross beams 13. Then open the cover plate 12, and use the matching draw hook to match with the second draw hole 34 on the top plate 33 to pull the top plate 33 out of the second slot 5. During the movement of the top plate 33 out of the second slot 5, the top plate 33 drives a plurality of second rollers 35 to generate autorotation, and change the sliding friction between top plate 33 and wedge tenon 14 into rolling friction, to facilitate the rapid dismantling of the top plate 33.

When the top plate 33 detaches from the second slot 5, the pressing against the wedge tenon 14 on the first main cross beam 13 by the common tenon 18 on the sub-cross beam 17 disappears, which is conducive to the rapid separation of the first main cross beam 13 from the upright post 3. At this time, a square rod is inserted into third slot 8 to push the first backing plate 26 out of groove 7. When the first backing plate 26 is located outside the first slot 6, the first backing plate 26 is pulled out of the first slot 6 through the matching of the draw hook and the first draw hole 8 on the first backing plate 26, so that the protrusion 27 on the first backing plate 26 is separated from the corresponding first roller 25, and the pressing against the first wedge 22 by the wedge block 23 disappears quickly, and then the pressing against the wedge block 23 by the first roller 25 disappears. When the pressing against first wedge 22 by the wedge block 23 disappears, the activity restriction of first wedge 22 in wedge mortise 4 is removed, and the first wedge 22 can be pushed out of wedge mortise 4 by manually pushing first wedge 22. After first wedge 22 is detached from wedge mortise 4, the pressing against two stepped wooden pins 20 that match with the first wedge 22 disappears, thus the pressing against on the two round wooden pins 21 used to locate the wedge tenon 14 and the upright post 3 disappears. At this time, the two round wooden pins 21 are manually pushed out of the corresponding first pin hole 10 and second pin hole 15, to remove the restriction between the first main cross beam 13 and upright post 3. At this time, the connection between the first main cross beam 13 and the upright post 3 is loosen, the main cross beam is dismantled directly from the upright post 3 and the stepped wooden pin 20 is removed.

Next, the second wedge 31 and third wedge 32 that fix the sub-cross beam 17 and upright post 3 are pushed into the wedge mortise 4 to unfix the sub-cross beam 17 and the upright post 3, and then remove the sub-cross beam 17 from the upright post 3. Finally the cover plate 12 is remounted to the mouth of the groove 7 through the bolt 19 and the top plate 33 B, first backing plate 26 and first roller 25 are covered inside the groove 7.

In summary, the present invention can achieve the following beneficial effects. The present invention realizes the quick mounting and dismounting of the first main cross beam 13 and the upright post 3 through the matching of the vertically movable wedge block 23 and the first wedge 14 that fixes the wedge tenon 14 to the wedge mortise 4. At the same time, because the wedge mortise 4 is connected to the common mortise 11, after dismounting the first main cross beam, the second wedge 31 and third wedge 32 are pushed into the wedge mortise 4 through tools, to achieve the removal of the sub-cross beam 17 from the upright post 3, thereby improving the efficiency of mounting and dismounting of the entire house. In the present invention, the fixed wall panel 36 of the gable is provided with a ventilation mechanism, and there is no need to mount additional air-conditioning equipment, thereby reducing the cost of air temperature adjustment in the house, and at the same time achieving the effects of energy saving and emission reduction.

The invention claimed is:

1. An easily mounted and dismounted wooden house, comprising a roof, a wooden frame mechanism, a base, and wooden fixed wall panels, wherein the wooden frame mechanism with the roof mounted on the top is inserted on the base; the wooden fixed wall panels with built-in thermal insulation layer are mounted around the wooden frame mechanism, and two of the wooden fixed wall panels opposite each other and without doors and windows provided thereon are provided with same ventilation structures;

the wooden frame mechanism comprises upright posts, a first main cross beam, a sub-cross beam, a first wedge, a wedge block, a first roller, a first backing plate, a second wedge, a third wedge, a top plate, a second roller, and a second main cross beam, wherein four upright posts are mortised by two symmetrically distributed first main cross beams and two symmetrically distributed sub-cross beams, the two first main cross beams are connected by two symmetrically distributed second main cross beams; the roof is mounted on the top of the four upright posts; a wedge tenon at one end of the first main cross beam matches a wedge mortise on the side wall of the upright post to prevent horizontal relative movement between the first main cross beam and the upright post that are mortised; an common mortise on the side wall of the upright post that is vertically connected to the wedge mortise is matched with an common tenon at one end of the sub-cross beam; the wedge block sliding vertically in the upright post is matched with the first wedge that fastens the corresponding wedge tenon to the corresponding wedge mortise; there are two rows of vertically distributed first rollers that roll horizontally in a groove on the side wall of the upright post, and a first backing plate that changes the distance between the two rows of first rollers is matched between the two rows of rollers, and the lower row of first rollers press against the wedge block;

the second wedge and the third wedge are fitted in the common mortise to fasten the common tenon inside; the wedge mortise is inserted with the top plate that is press-fitted with the corresponding second wedge, and a plurality of vertical second rollers are fitted between the top plate and the wedge tenon;

the top plate and a plurality of second rollers are matched with a slot on the side wall of the groove on the side wall of the upright post; when disassembling, the top plate is pulled out of the slot on the side wall of the groove on the side wall of the upright post first, and the top plate and the wedge tenon form rolling friction through the second roller, to facilitate the rapid disassembly of the top plate; after assembly, the plurality of second rollers on the top plate press against the side of the wedge tenon on the corresponding main beam A, thereby locking the relative position between the main beam A and the upright post.

2. The easily mounted and dismounted wooden house according to claim 1, wherein the fixed wall panel with ventilation structure is provided with a trapezoidal groove, and the trapezoidal groove is fitted with two right-angled trapezium movable wall panels for opening and closing, and the two movable wall panels are matched by teeth; a sealing gasket is mounted on the teeth surface of each movable wall panel; two fixing strips are mounted symmetrically on both sides of mouth of the trapezoidal groove, and a sealing strip that matches the corresponding movable wall panel is mounted on each fixing strip;

two threaded holes are symmetrically provided at the upper and lower ends of the two matched movable wall panels, and each threaded hole is screwed with a screw that drives the corresponding movable wall panel to move horizontally towards the outside of the house along the corresponding trapezoidal groove slope, and one end of each screw is mounted with a fourth bevel gear; two fourth bevel gears at the upper end of the two matched movable wall panels are engaged with each other, the two fourth bevel gears D at the lower end of the two matched movable wall panels are engaged with each other; the third fixing base mounted on the first main cross beam are rotatably matched with second shaft, and the third bevel gear mounted on the second shaft is engaged with the fourth bevel gear on the upper end of the movable wall panel on the same side; a third fixing base is mounted on the fifth fixing base that is mounted on the upright post, and the third fixing base is also rotatably matched with the second shaft, the third bevel gear mounted on the second shaft is engaged with the fourth bevel gear at the lower end of the movable wall panel on the same side; the first fixing base and second fixing base are mounted on the fifth fixing base and the first main cross beam on the same side respectively; the first fixing base and second fixing base are rotatably matched with the vertical first shaft, and the first shaft is driven to rotate by an electric drive module mounted on the first main cross beam; the first shaft is transmissibly connected with the two second shafts on the same side; the screw is rotatably fit with the fourth fixing base mounted on the corresponding first main cross beam or third fixing base.

3. The easily mounted and dismounted wooden house according to claim 2, wherein the teeth surface of one of the two movable wall panels that are matched with each other is provided with a groove and the teeth surface of the other movable wall panel is mounted with a baffle that is insertably matched with the groove, and there is a gap between the baffle and the inner wall of the groove; two first bevel gear are mounted symmetrically at both ends of first shaft, and the two first bevel gear are engaged with the second bevel gears mounted on the same side of second shaft respectively; a second spur gear is mounted on the second shaft, and the second spur gear is engaged with the first spur gear mounted on the output shaft of the electric drive module.

4. The easily mounted and dismounted wooden house according to claim 1, wherein the wedge block slides vertically in a sliding chute connecting the movable groove on the side wall of the upright post and the wedge mortise; a pressing plate is mounted on the upper end of the wedge block, and the pressing plate slides vertically in the movable groove on the side wall of the upright post; the pressing plate is pressed against by the lower row of first rollers; two side walls of the upright post are provided with a slot communicating with the movable groove on the side wall of the upright post and a slot matching the first backing plate; a cover plate that covers the first backing plate, the two rows of first rollers, the top plate and the plurality of second rollers is mounted through bolts at the mouths of the slot matching the first backing plate, the wedge mortise and the slot on the side wall of the groove on the side wall of the upright post.

5. The easily mounted and dismounted wooden house according to claim 4, wherein a second backing plate slides vertically in the groove on the side wall of the upright post, and the second backing plate is located above the upper row of first rollers; the upper and lower surfaces of the first backing plate are provided with protrusions that match the corresponding row of first rollers; the first backing plate is provided with a first draw hole that matches with the draw hook at the end close to the mouth of slot-A matching the first backing plate; and the top plate is provided with a second draw hole that matches with the draw hook at the end close to the mouth of slot on the side wall of the groove on the side wall of the upright post.

6. The easily mounted and dismounted wooden house according to claim 1, wherein the common mortise is provided with two first through pin holes connected to the corresponding wedge mortise symmetrically on both sides, and the wedge tenon is provided with two second pin holes one-to-one corresponding to the first pin holes; the inner wall of each second pin hole is provided with a stepped slot that is perpendicularly connected to the upper end surface of the corresponding wedge tenon; the corresponding first pin hole and second pin hole are matched with round wooden pins that prevent the wedge tenon from detaching the wedge mortise; the stepped slot is matched with the stepped wooden pin; the lower end of the stepped wooden pin is matched with the corresponding round wooden pin, and the upper end of the stepped wooden pin is matched with the first wedge.

* * * * *